US007376980B2

(12) United States Patent
Bullock et al.

(10) Patent No.: US 7,376,980 B2
(45) Date of Patent: May 27, 2008

(54) BICYCLE HELMET

(75) Inventors: Christopher Bullock, Campbell, CA (US); Chris Pietrzak, Park City, UT (US)

(73) Assignee: Specialized Bicycle Components, Inc., Morgan Hill, CA (US)

( * ) Notice: Subject to any disclaimer, the term of this patent is extended or adjusted under 35 U.S.C. 154(b) by 85 days.

(21) Appl. No.: 11/407,717

(22) Filed: Apr. 19, 2006

(65) Prior Publication Data

US 2006/0248630 A1 Nov. 9, 2006

Related U.S. Application Data

(60) Provisional application No. 60/673,498, filed on Apr. 20, 2005.

(51) Int. Cl.
*A42B 7/00* (2006.01)

(52) U.S. Cl. ..... 2/421

(58) Field of Classification Search ..... 2/411, 2/412, 425, 410, 417–422
See application file for complete search history.

(56) References Cited

U.S. PATENT DOCUMENTS

| | | | |
|---|---|---|---|
| 4,901,373 | A | 2/1990 | Broersma |
| 4,903,350 | A | 2/1990 | Gentes et al. |
| 5,023,958 | A | 6/1991 | Rotzin |
| 5,119,516 | A | 6/1992 | Broersma |
| 5,123,121 | A | 6/1992 | Broersma |
| 5,272,773 | A | 12/1993 | Kamata |
| 5,351,342 | A | 10/1994 | Garneau |
| 5,381,560 | A | 1/1995 | Halstead et al. |
| D361,407 | S | 8/1995 | Ho |

(Continued)

FOREIGN PATENT DOCUMENTS

| | | |
|---|---|---|
| EP | 0 581 460 A | 2/1994 |

(Continued)

OTHER PUBLICATIONS

U.S. Appl. No. 11/425,331, filed Jun. 20, 2006, Bullock.

(Continued)

*Primary Examiner*—Danny Worrell
(74) *Attorney, Agent, or Firm*—Knobbe, Martens, Olson & Bear, LLP

(57) ABSTRACT

A bicycle helmet having a body, which preferably includes both a base and a reinforcement structure. In one arrangement, the reinforcement structure is an external shell and, in another arrangement, the reinforcement structure is an internal skeletal frame. In some arrangements, the helmet body may include both an external shell and an internal frame. The helmet also includes a retention mechanism defining a contact surface configured to contact a rearward surface of the head of the user. A strap arrangement includes a first strap portion and second strap portion selectively connectable to one another to extend from opposing sides of the body and underneath a chin of the user. Desirably, no portion of the strap arrangement is secured to the retention mechanism. The strap arrangement includes a strap section extending through a pair of spaced openings in a lower, rearward portion of the body such that a portion of the strap section extends across an outer surface of the body between the openings. Preferably, each of the openings is sized and shaped to generally correspond with a cross-sectional size and shape of the strap section.

35 Claims, 12 Drawing Sheets

U.S. PATENT DOCUMENTS

| | | | | |
|---|---|---|---|---|
| D361,409 | S | 8/1995 | Ho | |
| D361,410 | S | 8/1995 | Ho | |
| D361,411 | S | 8/1995 | Ho | |
| D363,570 | S | 10/1995 | Ho | |
| D366,538 | S | 1/1996 | Ho | |
| 5,519,895 | A | 5/1996 | Barnes, Jr. | |
| 5,551,094 | A | 9/1996 | Navone | |
| 5,575,017 | A | 11/1996 | Hefling et al. | |
| 5,581,819 | A | 12/1996 | Garneau | |
| 5,598,588 | A | 2/1997 | Lee | |
| 5,794,272 | A | 8/1998 | Workman et al. | |
| 5,887,288 | A * | 3/1999 | Arney et al. | 2/421 |
| 5,898,950 | A | 5/1999 | Spyrou et al. | |
| 5,915,537 | A | 6/1999 | Dallas et al. | |
| 6,401,261 | B1 | 6/2002 | Arney et al. | |
| 6,425,142 | B2 * | 7/2002 | Sasaki et al. | 2/421 |
| 6,532,602 | B2 | 3/2003 | Watters et al. | |
| 6,912,736 | B2 * | 7/2005 | Moeller et al. | 2/421 |
| 2001/0022005 | A1 | 9/2001 | Sasaki et al. | |
| 2003/0221245 | A1 | 12/2003 | Lee et al. | |

FOREIGN PATENT DOCUMENTS

| | | |
|---|---|---|
| EP | 0 682 885 B2 | 6/2004 |
| WO | WO 95/01739 | 1/1995 |

OTHER PUBLICATIONS

U.S. Appl. No. 11/425,350, filed Jun. 20, 2006, Bullock.
Search Report for European Patent Application No. EP 06 00 7608, mailed Jul. 24, 2006.

* cited by examiner

BICYCLE HELMET

CROSS-REFERENCE TO RELATED APPLICATIONS

This application claims priority to U.S. Provisional Application No. 60/673,498, filed Apr. 20, 2005, the entire contents of which are incorporated by reference and should be considered a part of this specification.

BACKGROUND OF THE INVENTION

1. Field of the Invention

The present invention relates to protective helmets and bicycle helmets in particular. More specifically, the present invention relates to a helmet having an improved helmet strap arrangement.

2. Description of the Related Art

Bicycle helmets typically employ a strap system to secure the helmet to a user's head. The strap commonly includes two strap portions that extend from opposing sides of the helmet and are selectively joined together underneath the user's chin, often by a releasable snap fit connector. Each side strap typically includes a forward strap portion and a rearward strap portion which extend alongside forward and rearward sides, respectively, of the user's ear. The forward and rearward portions of the strap typically converge the below the ear and are connected, or extend together, to the end of the respective strap portion.

In prior art arrangements, the rearward strap portions are typically secured to the helmet at a single location at a rearward upper portion of the helmet or are connected to a retention assembly, which extends from a rearward portion of the helmet body to cradle the back of the user's head. With each of these common prior art arrangements, the straps tend to hang toward the center line of the helmet, become tangled with one another and usually require manual untangling or separation prior to putting on the helmet. Thus, it is difficult to put the helmet on quickly or put the helmet on with only one hand and have the straps properly located for use.

SUMMARY OF THE INVENTION

Preferred embodiments of the present invention provide an improved mounting arrangement for the rear helmet strap portions which facilitate the proper positioning of the straps to make the helmet easier to put on. Preferably, the improved arrangement includes the rear helmet strap passing through a lower rearward portion of the helmet body, as opposed to the retention mechanism, such that a portion of the helmet strap lies adjacent to an external surface of the helmet body. Desirably, the rearward portion of the helmet strap is supported by a generally rigid shell of the helmet body or by an internal reinforcement structure.

In accordance with one embodiment, a bicycle helmet is provided comprising a body having a concave inner surface configured to permit the helmet to sit on a head of a user. Said body comprises a base and a shell, said shell covering at least a portion of an outer surface of said base. The bicycle helmet also comprises a retention mechanism extending from a lower, rearward portion of said body and defining a contact surface configured to contact the head of the user. The bicycle helmet further comprises a strap arrangement having a first strap portion and second strap portion selectively connectable to one another to extend from opposing sides of said body and underneath a chin of the user. Said strap arrangement comprises a strap section extending through a pair of spaced openings in a lower, rearward portion of said body such that a portion of said strap section extends across an outer surface of said body between said openings, wherein no portion of said strap arrangement is secured to said retention mechanism.

In accordance with another embodiment, a bicycle helmet is provided, comprising a body having a concave inner surface configured to permit the helmet to sit on a head of a user and a support frame having at least a substantial portion thereof embedded within said body. The bicycle helmet also comprises a strap arrangement having a first strap portion and second strap portion selectively connectable to one another to extend from opposing sides of said body and underneath a chin of the user. Said strap arrangement comprises a strap section extending through a pair of spaced openings in a lower, rearward portion of said body such that a portion of said strap section extends across an outer surface of said body between said openings.

In accordance with still another embodiment, a bicycle helmet is provided comprising a body having a concave inner surface configured to permit the helmet to sit on a head of a user. Said body comprises a base and a reinforcement structure. The bicycle helmet also comprises a retention mechanism extending from a lower, rearward portion of said body and defining a contact surface configured to contact the head of the user. A strap arrangement has a first strap portion and second strap portion selectively connectable to one another to extend from opposing sides of said body and underneath a chin of the user. Said strap arrangement comprises a strap section extending through a pair of spaced openings in a lower, rearward portion of said body, wherein said spaced openings are spaced below a horizon passing through a leading edge of said body.

BRIEF DESCRIPTION OF THE DRAWINGS

These and other features, aspects and advantages of the present protective helmet are described in greater detail below with reference to several preferred embodiments, which are intended to illustrate, but not to limit the present invention. The drawings contain 12 figures.

In FIG. 8, the helmet strap is pulled away from the body of the helmet to illustrate a recess in which the helmet strap resides while the helmet is in use. As is apparent in FIG. 8, the helmet strap is supported by a portion of the helmet body that does not include an outer shell.

DETAILED DESCRIPTION OF THE PREFERRED EMBODIMENT

Figure 1:
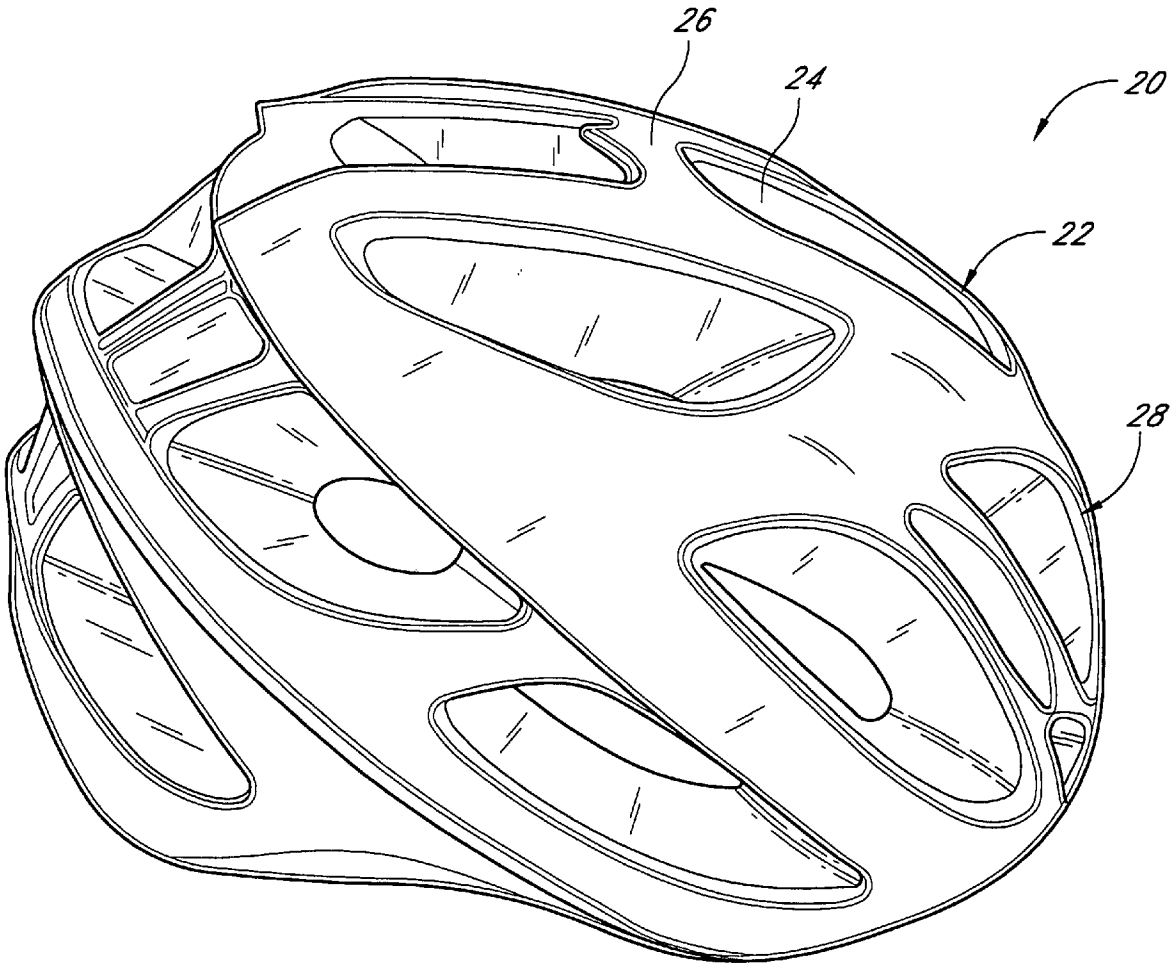
FIG. 1 is a perspective view of the top, right and rearward sides of a bicycle helmet having certain features, aspects and advantages of the present invention.

FIGS. 1-5 illustrate a preferred embodiment of a protective helmet, which is especially well suited for use as a bicycle helmet 20. The helmet 20 includes a body 22, which preferably is a composite structure. In the illustrated arrangement, the body 22 includes a base 24 and a shell 26. The shell 26 preferably covers at least a portion of an outer surface of the base 24 and, thus, defines at least a portion of the outer surface of the helmet body 22. The helmet body 22 preferably makes up the protective, impact resistant portion of the helmet 20. Desirably, the helmet body 22 includes multiple ventilation openings 28, which in the illustrated arrangement are spaced along the front, top and rearward sides of the helmet 20. The ventilation openings 28 permit airflow through the helmet 20 and preferably define an opening area at the outer surface of the body 22 of at least about one-half square inch.

Figure 4:
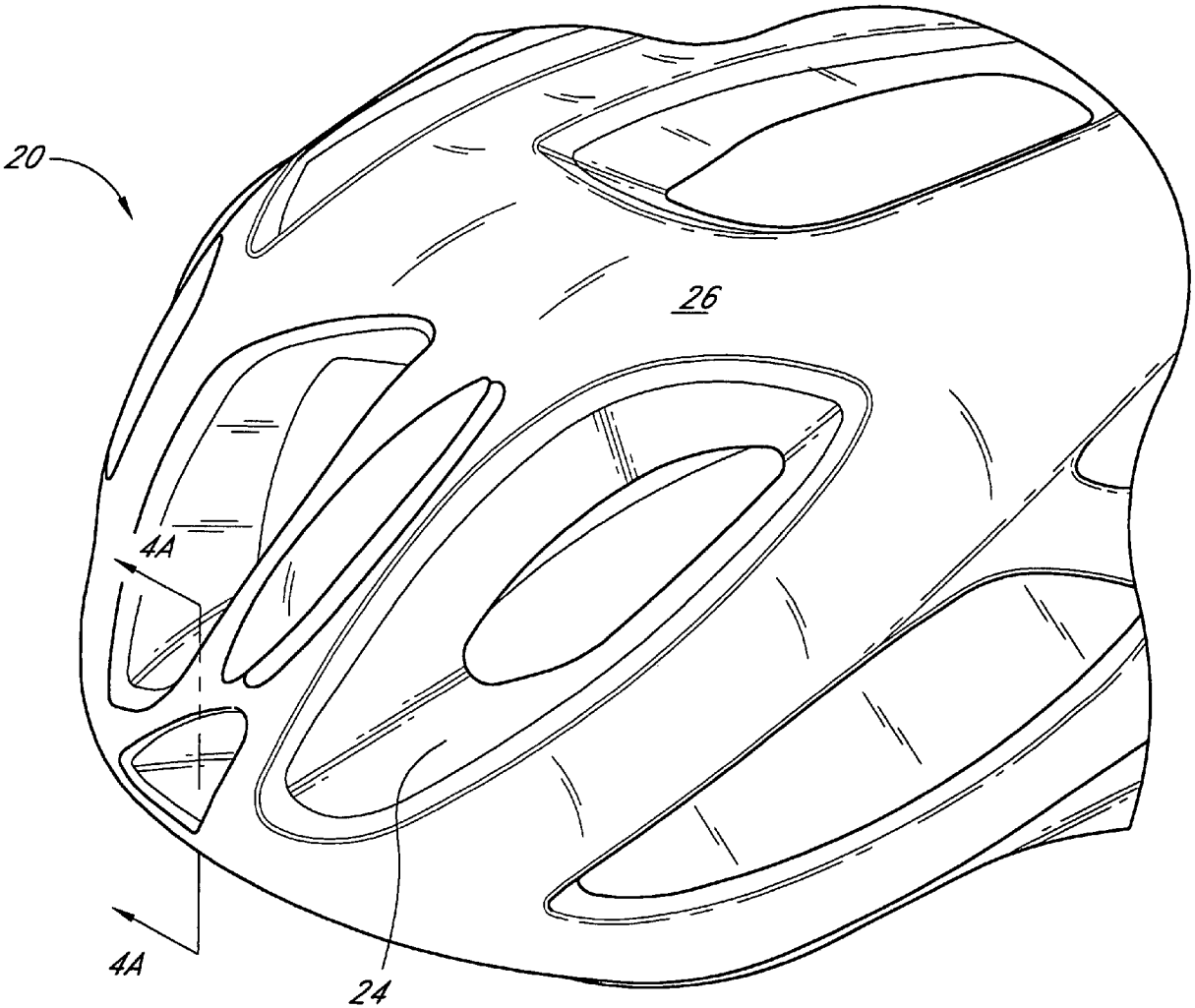
FIG. 4 is a partial view of a front portion of the helmet of FIG. 1 illustrating a preferred mounting arrangement for a front portion of the helmet strap.
Figure 4A:
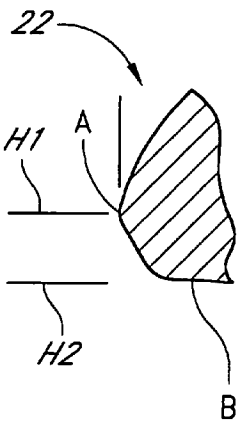
FIG. 4*a* is an enlarged view of a central portion of the front of the helmet shown in FIG. 4.

With reference to FIGS. 4 and 4*a*, the body 22 of the helmet defines a leading edge A or a forward-most edge of the helmet body 22. In addition, a forward end of the helmet body 22 preferably defines a lower front edge B, or a lower edge of a central portion of the front end of the helmet body 22. As used herein, a horizon refers to an imaginary horizontal plane relative to the helmet 20 when the helmet 20 is sitting in a substantially level manner on a user. A first horizon H1 passes through the leading edge A and a second horizon passes through the lower front edge B, as illustrated in FIG. 4*a*.

The base 24 of the helmet 20 preferably is constructed from an energy absorbing material, such as an expanded foam material, for example. However, other suitable materials may also be used. The base 24 may be constructed from a variety of suitable manufacturing techniques that are known or apparent to one of skill in the art. The base 24 may be constructed of a single piece of material or may be constructed of multiple components. If the base 24 is constructed from multiple components, the components may be formed separately and then joined together or may be formed as individual layers of a unitary structure. For example, in one arrangement, multiple components may be joined together by an internal support structure or multiple materials may be molded in successive steps to form a unitary structure.

The shell 26 preferably covers a portion of an outer surface of the base 24 and, desirably, provides protection to the base 24 in addition to improving the overall appearance of the helmet 20. In addition, the shell 26 may also provide an energy absorbing function. In the illustrated arrangement, the shell 26 covers a substantial portion of the outer surface of the base 24, including forward, side, top and rearward portions of the base 24. Preferably, the shell 26 is a relatively thin layer of a plastic material. Desirably, an average thickness of the shell 26 is substantially less than an average thickness of the base 24. In one arrangement, the shell 26 may be injection molded onto a base 24 that has been formed in a previous process step.

Preferably, the helmet 20 also includes a retention mechanism 30, which extends below a lower, rearward portion of the helmet body 22. Desirably, the retention mechanism 30 is configured to contact a lower, rearward portion of the user's head to assist in securing the helmet 20 onto the user and inhibit undesired movement of the helmet 20. Preferably, the retention mechanism 30 only contacts a rearward portion of the user's head. In the illustrated arrangement, the retention mechanism 30 is adjustable relative to the base 24 of the helmet body 22. Thus, in the illustrated arrangement, the retention mechanism 30 is also adjustable relative to the shell 26.

Figure 3:
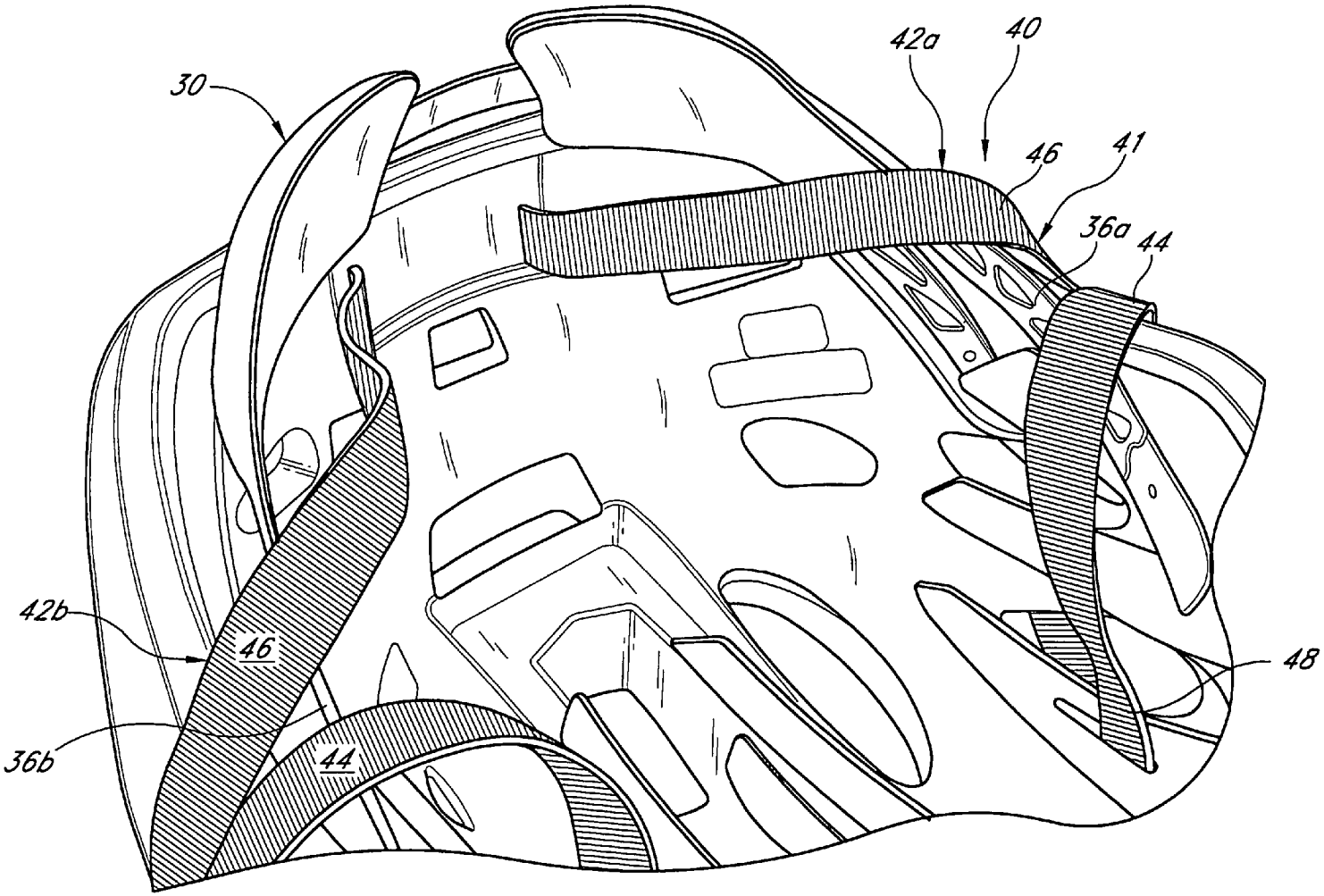
FIG. 3 is a view of a rearward portion of the inner surface of the bicycle helmet of FIG. 1.

In the illustrated arrangement, the retention mechanism 30 includes two lateral portions 32*a* and 32*b*, which preferably define the contact surfaces of the retention mechanism 30. Desirably, the lateral portions 32*a*, 32*b* are adjustable relative to one another to permit a user to adjust the fit of the helmet 20. In the illustrated arrangement, the lateral portions 32*a*, 32*b* are interconnected and slidable along a bridge member 34, or strap. The lateral portions 32*a*, 32*b* and the bridge member 34 may be constructed such that the lateral portions 32*a*, 32*b* are held in a desired position relative to the bridge member 34, such as by utilizing interference surface features. With reference to FIG. 3, desirably the lateral portions 32*a*, 32*b* are secured to the body 22 of the helmet 20 by forwardly extending portions 36*a* and 35*b*, which may connect to the body 22 by a snap fit arrangement, as is known in the art.

The helmet 20 also includes a strap arrangement 40 configured to assist in securing the helmet 20 to a user's head. The strap arrangement 40 preferably includes strap (generally referred to by the reference numeral 41) which may be constructed of one or more pieces and secured to one or more locations of the helmet body 22. Preferably, the strap 41 includes a right side portion 42*a* and a left side portion 42*b*. The right side portion 42*a* and left side portion 42*b* preferably are configured to extend along the respective sides of a user's head and interconnect with one another, preferably under the user's chin. The interconnection of the right side portion 42*a* and left side portion 42*b* may be accomplished in any suitable manner, such as the use of a connector, for example. The connector may utilize a releasable, snap lock mechanism, as will be appreciated by one of skill in the art.

Preferably, each of the right side portion 42*a* and the left side portion 42*b* of the strap arrangement 40 includes a forward strap section 44 and a rearward strap section 46. The strap arrangement 40 is configured such that the forward strap section 44 and the rearward strap section 46 extend from respective forward and rearward locations on an inner surface of the helmet body 22. The forward and rearward strap members 44, 46 are arranged to pass along forward and rearward sides of the user's ear and converge at a point below the ear. From the point of convergence, the forward and rearward strap members 44, 46 may be joined together or may be extend alongside (or on top of) one another toward their respective ends. Typically, the forward and rearward strap members 44, 46 pass through an adjustment mechanism (not shown) at the point of convergence.

In the illustrated arrangement, the above-described strap portions are constructed from a single strap 41 having a first end 48 secured to a forward right side of the helmet body 22. The strap 41 extends from the first end 48 toward the converging point of the forward strap section 44 and rearward strap section 46 and then to the connector between the right side strap portion 42*a* and the left side strap portion 42*b*. The strap then doubles back on itself from the connector toward the converging point of the forward strap section 44 and rearward strap section 46 and then continues on to a rearward right side location of the helmet body 22. The portion of the strap material between the converging point and the rearward location of the helmet body 22 is referred to herein as the rearward strap section 46.

Figure 2:
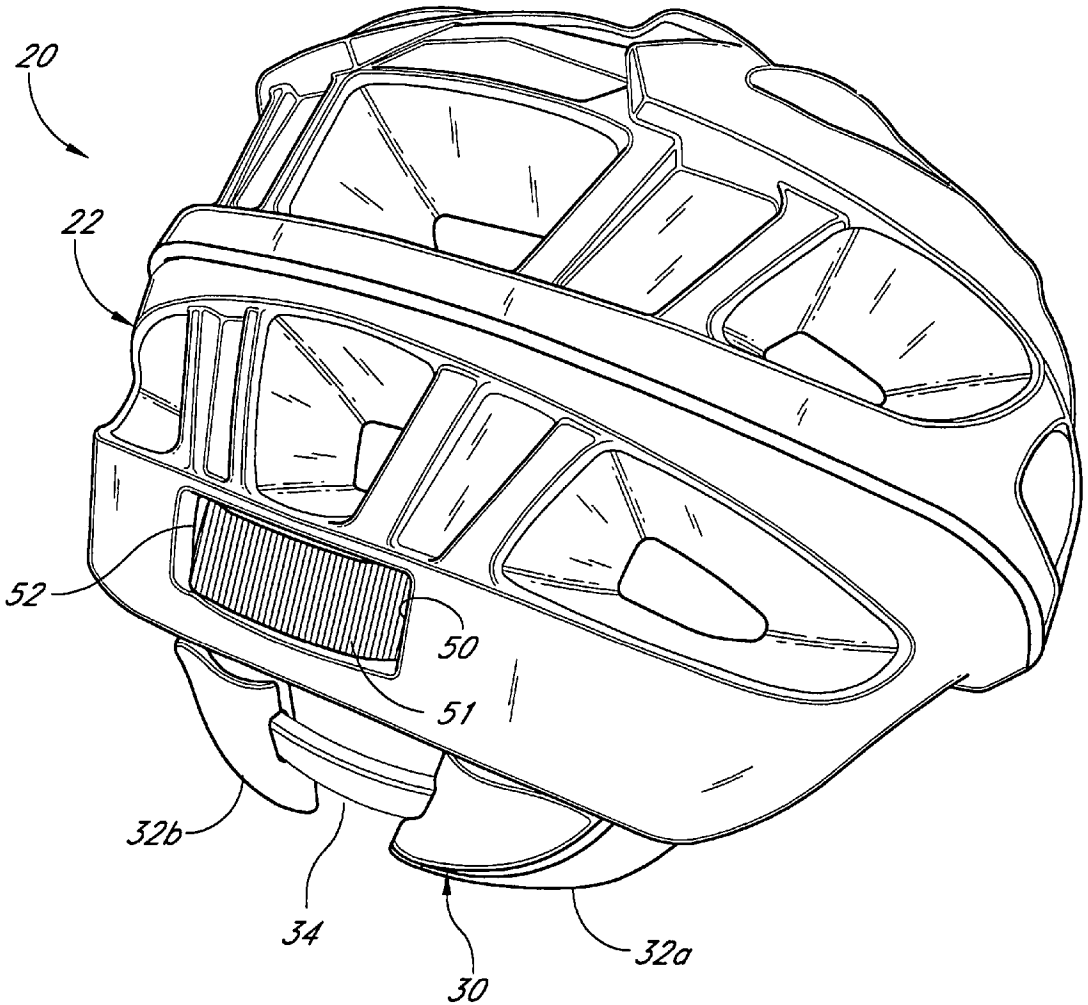
FIG. 2 is a rearward view of the bicycle helmet of FIG. 1 illustrating a preferred mounting arrangement for a rearward portion of the helmet strap.

As shown in FIGS. 2 and 3, the strap 41 passes through an opening 50 in a lower, rearward portion of the helmet body 22 from the inside of the helmet body 22 to the outside of the helmet body 22. The strap 41 includes a strap section 51 that extends over and along a portion of the outer surface of the helmet body 22 and reenters a second opening 52 spaced from the opening 50 on a lower rearward portion of the helmet body 22. In the illustrated embodiment, as discussed above, the shell 26 covers the rearward portion of the base 24. Accordingly, in the illustrated embodiment the strap 41 extends through the base 24 and the shell 26 of the body 22, and the strap section 51 extends over and along an outer surface of the shell 26. In another embodiment, discussed below, the strap 41 can also extend through an internal reinforcement structure embedded in the base 24.

After passing from an outside of the helmet body 22 to the inside of the helmet body 22 through the opening 52, the strap 41 is arranged to form the rearward strap section 46 and forward strap section 44, as well as the portion of the left side helmet strap portion 42*b* beyond the converging point, which interconnects with the right side portion 42*a*, in a manner substantially as described above with respect to the right side portion 42*a*. In the illustrated arrangement, the strap 41 ultimately terminates at a second end 54 (FIG. 5).

Figure 5:
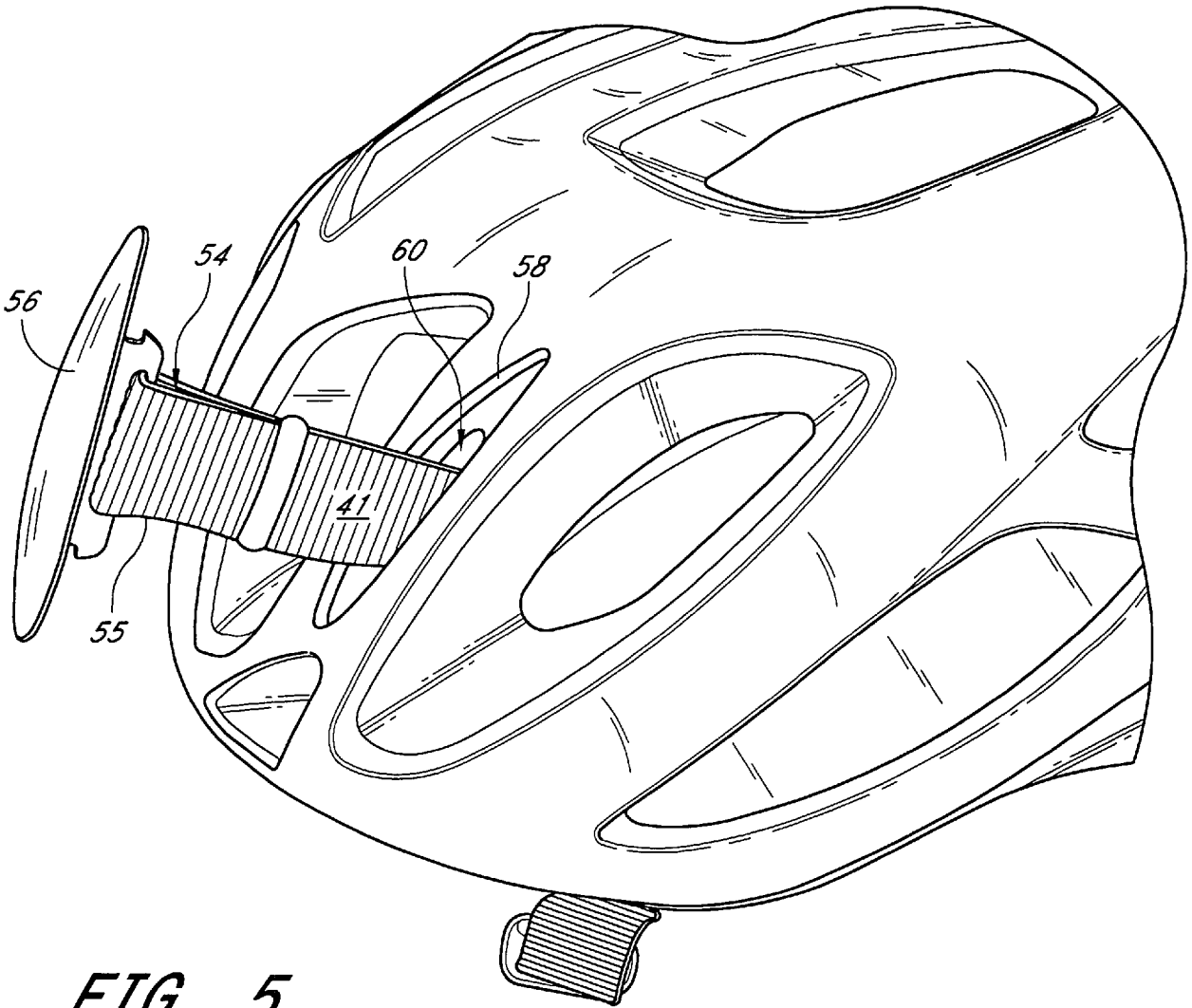
FIG. 5 is another view of the mounting arrangement for the forward helmet strap, with a strap anchor pulled away from the body of the helmet.
Figure 6:
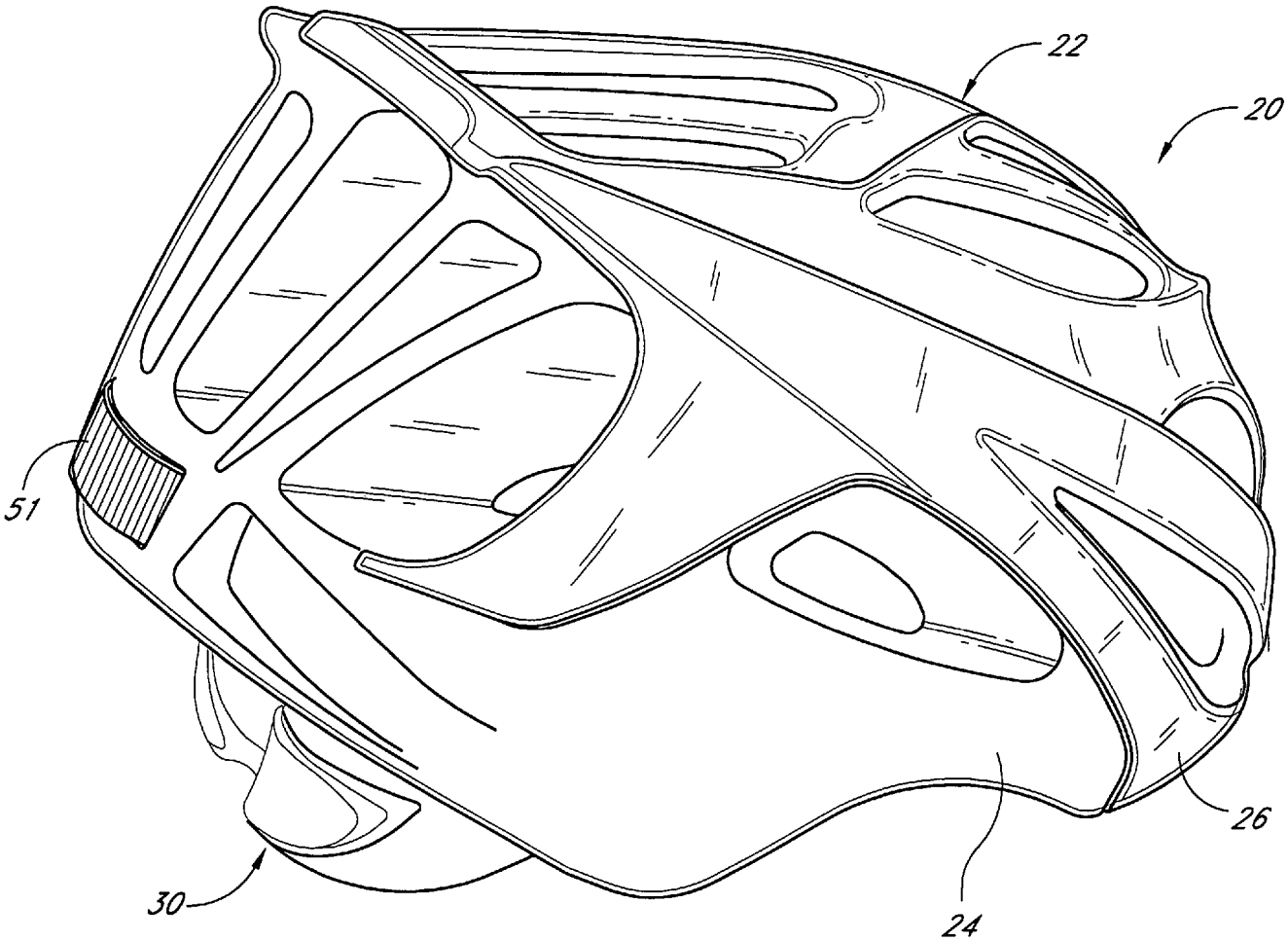
FIG. 6 is a top, right side and rear perspective view of a modification of the helmet of FIGS. 1-5.
Figure 7:
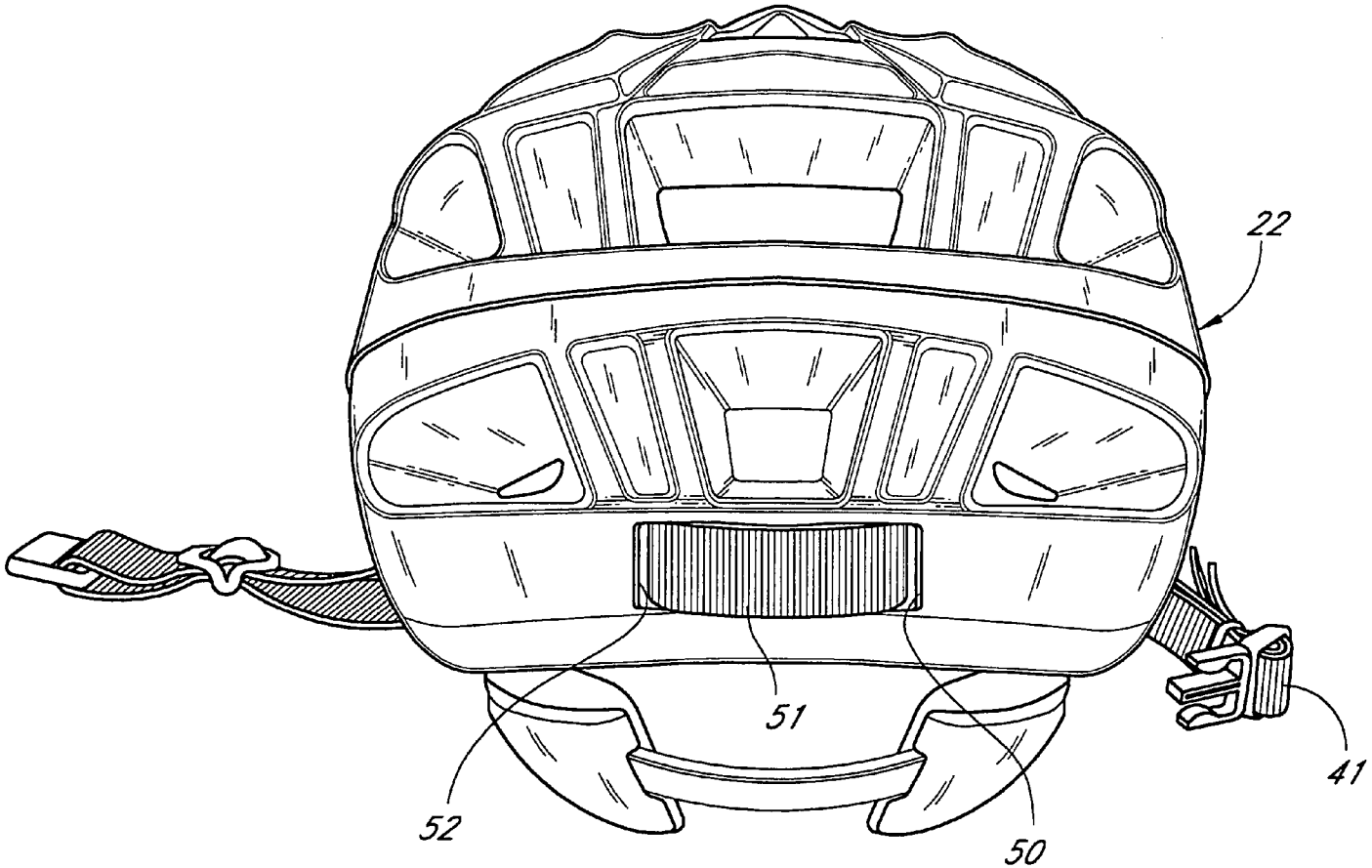
FIG. 7 is a rear view of the helmet of FIG. 6, illustrating a preferred mounting arrangement of a rearward section of the helmet strap.
Figure 8:
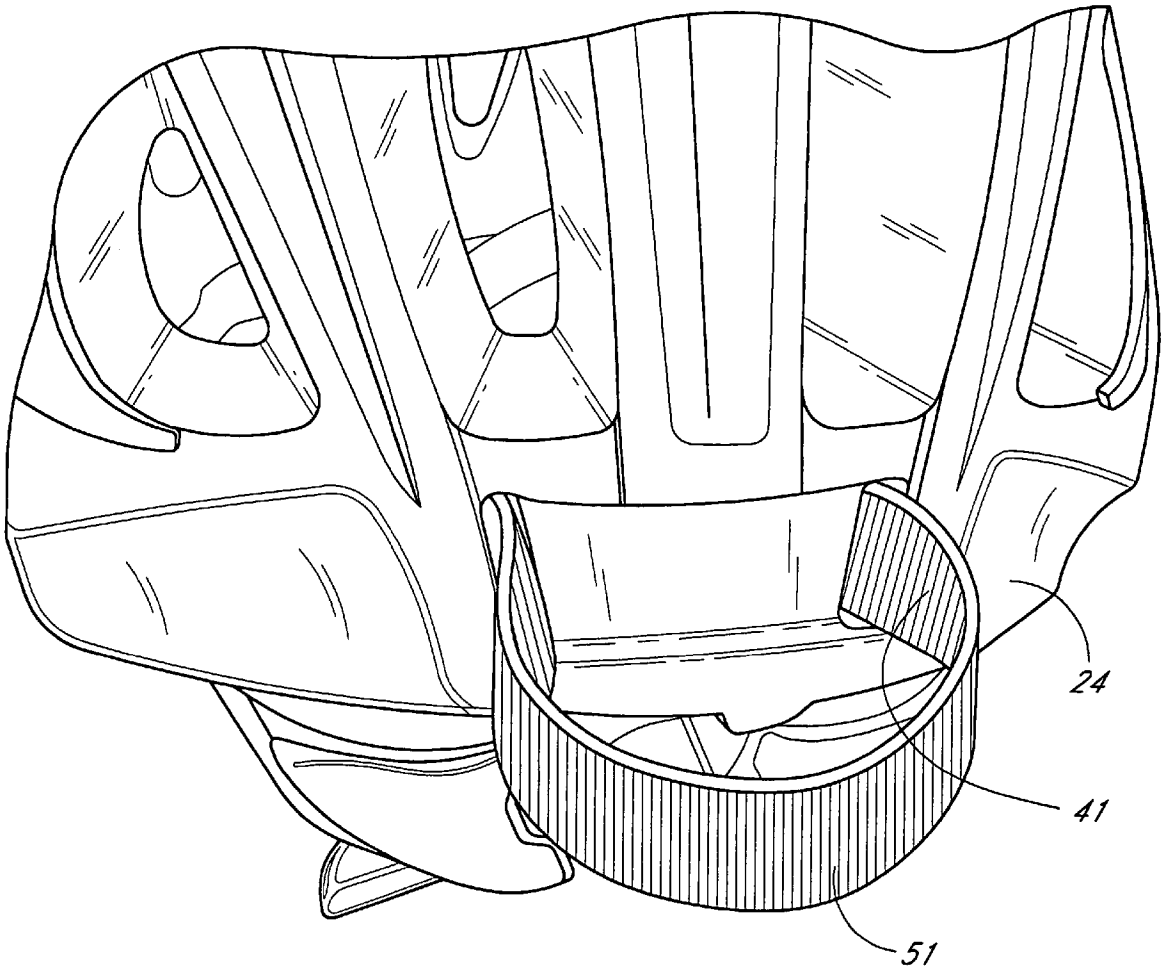
FIG. 8 is an enlarged view of the mounting arrangement for the rearward section of the helmet strap illustrated in FIG. 7.
Figure 9:
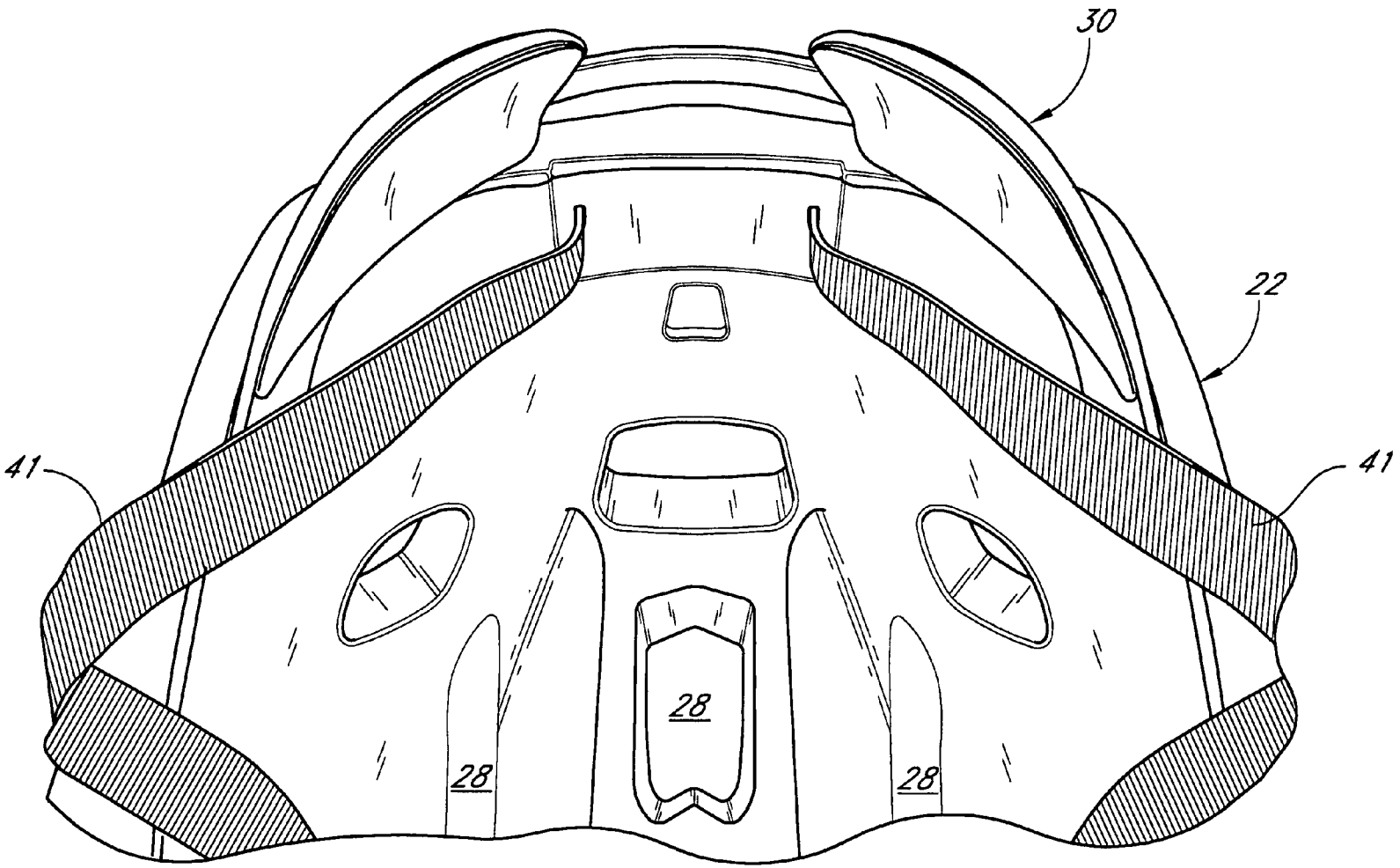
FIG. 9 is a view of a rearward portion of the inner surface of the helmet of FIG. 6 illustrating the mounting arrangement of the rearward portion of the strap from the inside of the helmet.

With reference to FIGS. 4 and 5, a coupling between the second end 54 of the strap and the helmet body 22 is illustrated. Preferably, the second end 54 of the strap 41 includes a loop 55 that is secured to an anchor member 56. The helmet body 22 preferably defines a recess 58 that is sized and shaped to receive the anchor member 56. In the center of the recess 58 is an opening 60 which passes through the helmet body 22 to permit the strap to pass from the outside to the inside of the helmet body 22. The anchor member 56 transfers a load from the strap to the helmet body 22. Desirably, the first end 48 of the strap is coupled to a forward right side portion of the helmet body 22 in a similar manner. However, other suitable arrangements to secure a forward end of the helmet strap arrangement 40 to the helmet body 22 may also be used. For example, in some arrangements, the forward ends of the strap may be secured to the helmet body 22 at a single location.

As described above, preferably the rearward strap members 46 of the strap arrangement 40 are secured to a lower, rearward portion of the helmet body 22 and, desirably, are not secured or attached to the retention mechanism 30. Such an arrangement permits the adjustment of the strap arrangement 40 and the retention mechanism 30 to be accomplished separately without having an affect on one another. Accordingly, a user of the helmet 20 may optimize the adjustment of both the strap arrangement 40 and the retention mechanism 30 to achieve a desired level of securement and comfort of the helmet 20.

Desirably, as described above, the openings 50 and 52 through which the rearward strap members 46 pass between the outside of the helmet body 22 and the inside of the helmet body 22 are spaced apart from one another. Such an arrangement facilitates the right side portion 42*a* and left side portion 42*b* of the helmet strap 41 to be held in a spaced-apart orientation such that the helmet 20 may be simply and quickly put on without necessitating excessive pre-arrangement of the straps. In the illustrated arrangement, the openings 50 and 52 are spaced approximately 45 millimeters apart. Preferably, such a spacing represents less than approximately one-third of the overall width of the helmet 20. However, in other arrangements other spacings of the openings 50, 52 may be employed to achieve a desired positioning of the rearward strap members 46.

As described above, preferably the rearward strap members 46 and the openings 50, 52 are located near a lower rearward end of the helmet body 22. With additional reference to FIG. 4*a*, preferably, the openings 50, 52 are spaced below the horizon H1 passing through the leading edge A and, more preferably, spaced below the horizon H2 passing through the lower front edge B. Preferably, the openings 50, 52 are spaced at least one inch below one or both of the horizons H1 and H2. In the illustrated arrangement, the openings 50, 52 and thus a lower edge of the exposed strap section 51 is spaced less than or equal to about 10 millimeters from a lower edge of the helmet body 22. In addition, the helmet strap material preferably is about 15 millimeters in width (or height). Such an arrangement permits the rearward vent openings 28 to occupy a majority of a rearward side of the helmet body 22 without the straps having to pass through or interfere with the ventilation openings 28, which preferably have an opening area at the outer surface of the helmet body 22 of at least about one-half square inch.

Advantageously, the combination of the base 24 and outer shell 26 provide sufficient support the external portion of the rearward strap members 46 at such close proximity to the lower edge of the helmet body 22. Desirably, the shape and size of the openings 50, 52 are specifically configured to receive the rearward strap members 46 without substantial additional space. That is, preferably, the openings 50, 52 are not simply vent openings 28, but generally correspond in size and shape to the cross-sectional size and shape of the strap 41. In a preferred arrangement, the openings have a cross sectional area of no more than about one-sixteenth square inch.

Preferably, an outer surface of the helmet body 22 includes a recess 60 that extends between the opening 50 and the opening 52. Desirably, the recess 60 is sized and shaped to accommodate the exposed strap section 51 and, preferably, sized and shaped to generally correspond to the size and shape of the exposed strap section 51. In such an arrangement, preferably, and outer surface of the strap section 51 lies generally flush with an outer surface of the helmet body 22 adjacent the recess 60. In one preferred arrangement, the recess 60 does not extend beyond the space between the openings 50, 52 in a vertical or horizontal direction, or both.

FIGS. 6-10 illustrate a modification of the helmet 20 of FIGS. 1-5. The helmet 20 of FIGS. 6-10 is similar to the helmet 20 of FIGS. 1-5 and, accordingly, like reference numerals are used to denote like components.

The helmet 20 of FIGS. 6-10 also includes a helmet body 22, which preferably includes a base 24 and a shell 26. However, in the helmet 20 of FIGS. 6-10, the lower rearward portion of the helmet body 22 that defines the openings 50 and 52 preferably does not include the external shell 26. That is, the portion of the helmet body 22 that includes the openings 50, 52 is defined by the base 24 portion of the body 22.

Figure 10:
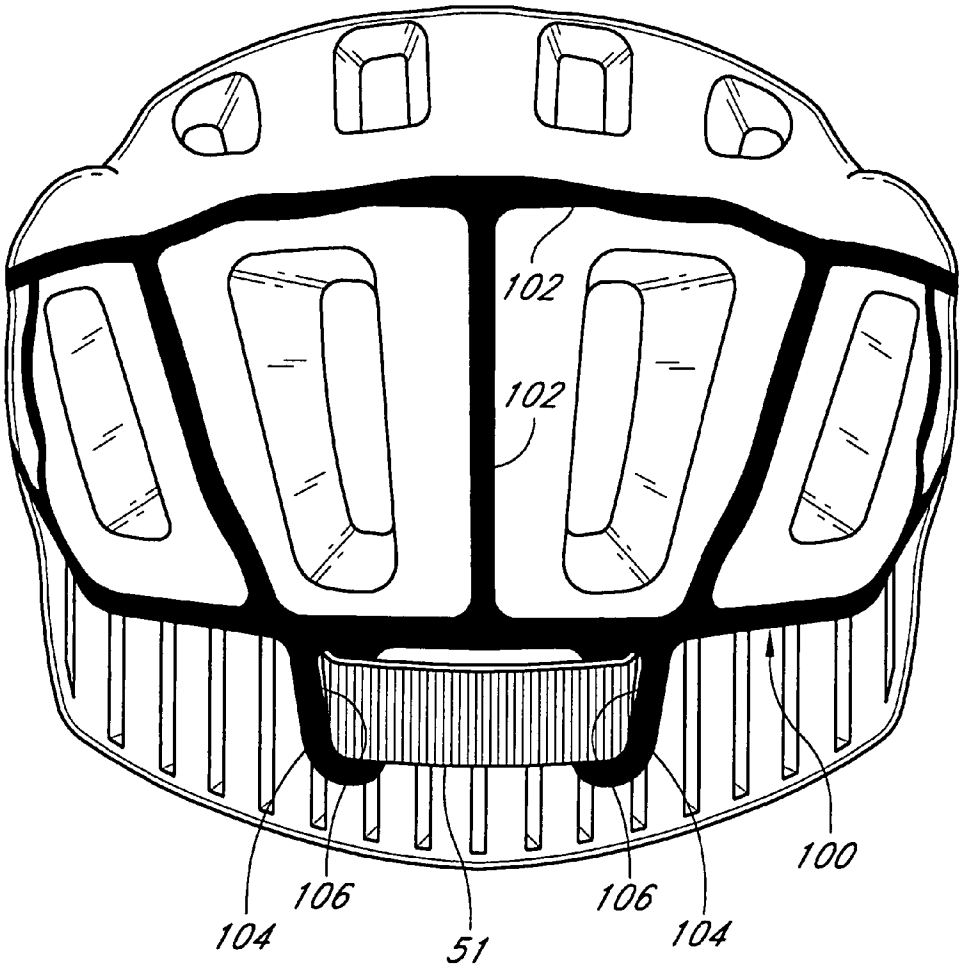
FIG. 10 is a sectional view of the helmet of FIG. 6 with a portion of the body removed to illustrate an internal reinforcement member. Preferably, the rearward portion of the helmet strap is supported by the internal reinforcement member.

With reference to FIG. 10, desirably the helmet 20 of FIGS. 6-10 includes an internal reinforcement structure 100 or internal skeletal frame. The internal reinforcement structure 100 may be constructed from any suitable material using any suitable manufacturing technique or methods. For example, in one arrangement, the internal reinforcement structure 100 is constructed of a composite material, preferably having unidirectional fiber orientation. Desirably, the internal reinforcement structure 100 is substantially entirely embedded within the base 24 of the helmet body 22. In some arrangements, a portion of the reinforcement structure 100 may be exposed external of the helmet body 22 and may be used to support front ends of the helmet strap arrangement 40, for example.

The helmet body 22, incorporating the internal reinforcement structure 100, may be manufactured by any suitable method. For example, the base 24 of the helmet body may be constructed in a first portion, the reinforcement structure 100 assembled to the first portion and then the remainder of the base 24 may be formed over the combination of the first portion and the reinforcement structure 100. Alternatively, the base 24 may be constructed of individually fabricated portions which are interconnected and which may be interconnected at least in part by the reinforcement structure 100.

As illustrated in FIG. 10, preferably the reinforcement structure 100 is comprised of a plurality of elongate portions 102 that are interconnected to one another. Desirably, the internal reinforcement structure 100 includes a pair of extensions 104, each of which defines an opening 106. The extensions 104 are sized, shaped, and spaced from one another such that the openings 106 correspond with the openings 50, 52 of the helmet body 22. Accordingly, the rearward strap section 46 preferably passes through the openings 106 in addition to passing through the openings 50, 52 of the helmet body 22. That is, the rearward strap section 46 extends through the base 24 and the internal reinforcement structure 100 so that the section of the strap 51 extends over and along an outer surface of the body 22 between the openings 106, 50, 52. Accordingly, the internal reinforcement structure 100 provides reinforcement to the strap arrangement 40 in the absence of the outer shell 26 at the location of the engagement of the rearward strap section 46 and the helmet body 22. However, in an alternative embodiment, the helmet 20 may utilize both the internal reinforcement structure 100 and the external helmet shell 26. That is, the rearward strap section 46 can extend through the base 24, the internal reinforcement structure 100 and the shell 26, so that the section of the strap 51 extends over and along an outer surface of the shell 26 of the body 22 between the openings 106, 50, 52.

Figure 11:
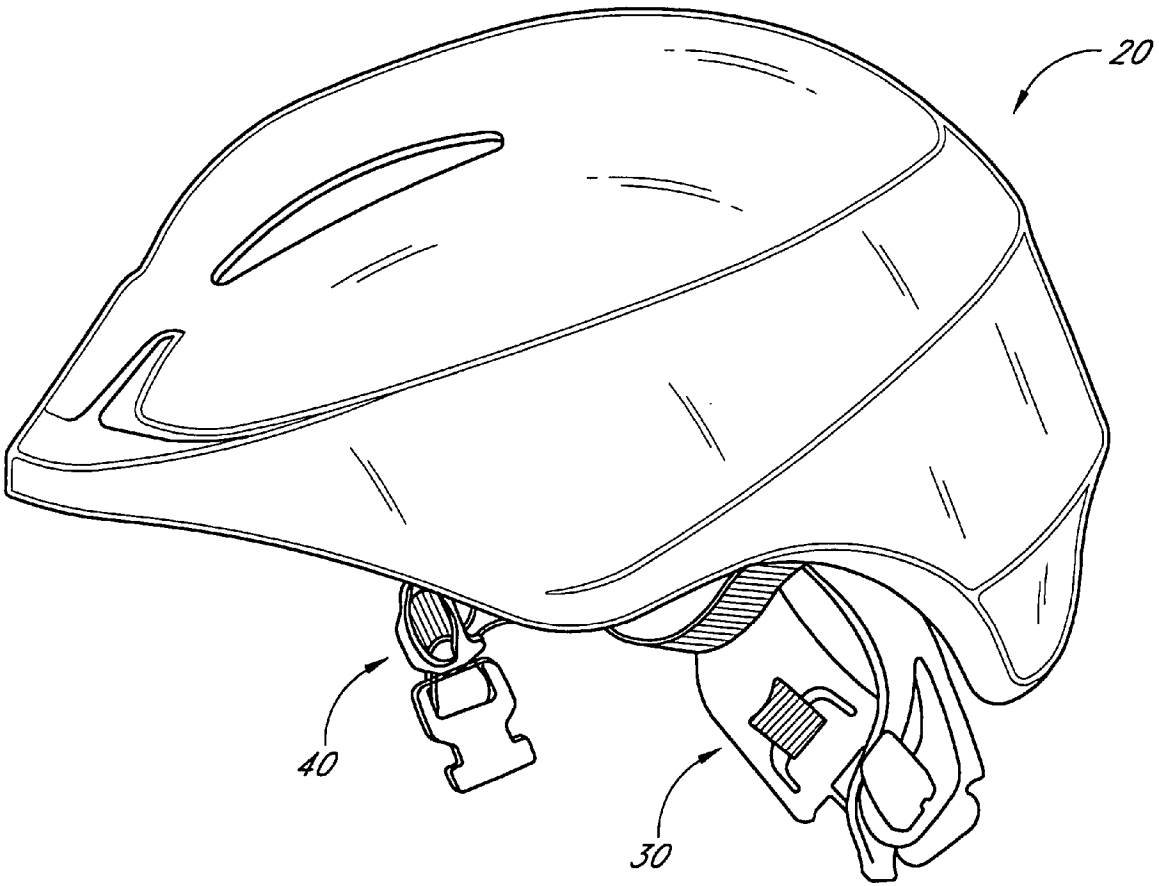
FIG. 11 is a side view of a modification of the helmets of FIGS. 1-10. The helmet of FIG. 11 includes a body, the outer surface of which is substantially entirely covered by a shell.
Figure 12:
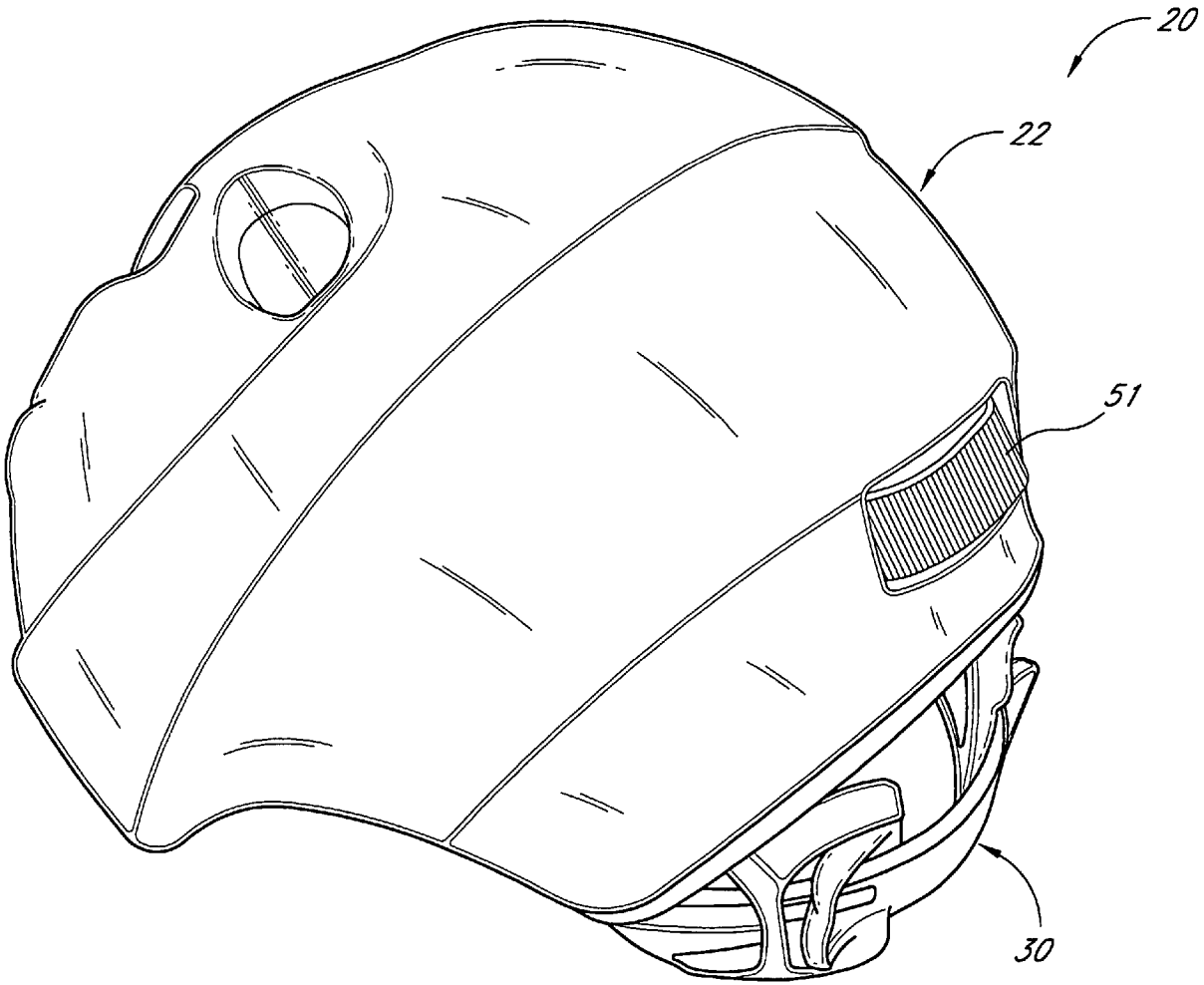
FIG. 12 is a perspective view of the helmet of FIG. 11 illustrating a preferred mounting arrangement for a rearward section of the helmet strap.

FIGS. 11 and 12 illustrate yet another modification of the helmets 20 of FIGS. 1-5 and 6-10. The helmet 20 of FIGS. 11 and 12 is substantially similar to the helmets 20 described above with reference to FIGS. 1-10 and, therefore, like reference numerals are used to denote like components.

The helmet 20 of FIGS. 11 and 12 includes a body 22 having a base 24 and an outer shell 26. The helmet 20 also includes a retention mechanism 30 and strap arrangement 40. The helmet 20 of FIGS. 11 and 12 includes only a small number of vent openings 28, preferably which are located on the upper surface or top surface of the helmet 20. In addition, the outer shell 26 covers substantially the entire outer surface of the base 24.

In addition, the openings 50, 52 are spaced somewhat further from a lower edge of the rearward portion of the helmet body 22 in comparison to the helmets 20 of FIGS. 1-5 and FIGS. 6-10. For example, in the illustrated arrangement, the openings 50, 52 are spaced from a lower edge of the helmet body 22 such that a lower surface of the rearward strap section 46 is located approximately 15 mm from the lower edge of the helmet body 22. However, the rearward strap section 46 may be disposed closer or further from the lower edge of the helmet body 22 if desired.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present helmet has been described in the context of particularly preferred embodiments, the skilled artisan will appreciate, in view of the present disclosure, that certain advantages, features, and aspects of the helmet may be realized in a variety of other applications, many of which have been noted above. Additionally, it is contemplated that various aspects and features of the invention described can be practiced separately, combined together, or substituted for one another, and that a variety of combination and sub-combinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. A bicycle helmet, comprising:

a body having a concave inner surface configured to permit the helmet to sit on a head of a user, said body comprising a base and a shell, said shell covering at least a portion of an outer surface of said base;

a retention mechanism extending from a lower, rearward portion of said body and defining a contact surface configured to contact the head of the user; and a strap arrangement having a first strap portion and second strap portion selectively connectable to one another to extend from opposing sides of said body and underneath a chin of the user, said strap arrangement comprising a strap section extending through a pair of spaced openings in a lower, rearward portion of said body such that a portion of said strap section extends across an outer surface of said body between said openings, wherein no portion of said strap arrangement is secured to said retention mechanism, wherein the pair of spaced openings extend through the base and the shell so that the portion of said strap section extends over an outer surface of the shell of said body between said openings.

2. The bicycle helmet of claim 1, wherein said spaced openings are spaced below a horizon passing through a leading edge of said body.

3. The bicycle helmet of claim 1, wherein said spaced openings are spaced below a horizon passing through a lower front edge of said body.

4. The bicycle helmet of claim 1, additionally comprising one or more ventilation openings defined within a rearward portion of said body, wherein said spaced openings are disposed between a lower edge of said body and said ventilation openings.

5. The bicycle helmet of claim 1, additionally comprising one or more ventilation openings defined within said body, wherein said ventilation openings have an area of at least about one-half square inch.

6. The bicycle helmet of claim 5, wherein said spaced openings each have an area of about one-sixteenth square inch.

7. The bicycle helmet of claim 1, wherein said body defines a recess between said spaced openings and said strap section is received within said recess.

8. The bicycle helmet of claim 1, wherein said pair of openings are spaced no more than about 45 millimeters apart.

9. The bicycle helmet of claim 1, wherein said spaced openings define a linear distance therebetween which is no more than about one-third of a width of said body.

10. The bicycle helmet of claim 1, wherein each of said openings is sized and shaped to generally correspond with a cross-sectional size and shape of said strap section.

11. The bicycle helmet of claim 1, wherein a lower edge of said spaced openings are located no more than about 15 millimeters from a lower, rearward edge of said body.

12. The bicycle helmet of claim 1, wherein each of said spaced openings are elongate in shape and oriented substantially vertically.

13. The bicycle helmet of claim 1, wherein said retention mechanism is movable relative to said body.

14. A bicycle helmet, comprising:

a body having a concave inner surface configured to permit the helmet to sit on a head of a user;

a support frame having at least a substantial portion thereof embedded within said body; and a strap arrangement having a first strap portion and second strap portion selectively connectable to one another to extend from opposing sides of said body and underneath a chin of the user, said strap arrangement comprising a strap section extending through a pair of spaced openings in a lower, rearward portion of said body such that a portion of said strap section extends across an outer surface of said body between said openings, wherein the pair of spaced openings extend through the support frame so that said strap section extends through the frame and over the outer surface of the body between said openings.

15. The bicycle helmet of claim 14, wherein the pair of spaced openings further extend through a shell covering at least a portion of the outer surface of the base so that said strap section extends over an outer surface of the shell between said openings.

16. The bicycle helmet of claim 14, wherein said spaced openings are spaced below a horizon passing through a leading edge of said body.

17. The bicycle helmet of claim 14, wherein said spaced openings are spaced below a horizon passing through a lower front edge of said body.

18. The bicycle helmet of claim 14, additionally comprising one or more ventilation openings defined within a rearward portion of said body, wherein said spaced openings are disposed between a lower edge of said body and said ventilation openings.

19. The bicycle helmet of claim 14, additionally comprising one or more ventilation openings defined within said body, wherein said ventilation openings have an area of at least about one-half square inch.

20. The bicycle helmet of claim 19, wherein said spaced openings each have an area of about one-sixteenth square inch.

21. The bicycle helmet of claim 14, wherein said body defines a recess between said spaced openings and said strap section is received within said recess.

22. The bicycle helmet of claim 14, wherein said pair of openings are spaced no more than about 45 millimeters apart.

23. The bicycle helmet of claim 14, wherein said spaced openings define a linear distance therebetween which is no more than about one-third of a width of said body.

24. The bicycle helmet of claim 14, wherein each of said openings is sized and shaped to generally correspond with a cross-sectional size and shape of said strap section.

25. The bicycle helmet of claim 14, wherein a lower edge of said spaced openings are located no more than about 14 millimeters from a lower, rearward edge of said body.

26. The bicycle helmet of claim 14, wherein each of said spaced openings are elongate in shape and oriented substantially vertically.

27. A bicycle helmet, comprising:

a body having a concave inner surface configured to permit the helmet to sit on a head of a user, said body comprising a base and a reinforcement structure;

a retention mechanism extending from a lower, rearward portion of said body and defining a contact surface configured to contact the head of the user; and a strap arrangement having a first strap portion and second strap portion selectively connectable to one another to extend from opposing sides of said body and underneath a chin of the user, said strap arrangement comprising a strap section extending through a pair of spaced openings in a lower, rearward portion of said body, said spaced openings extending through the reinforcement structure;

wherein said spaced openings are spaced below a horizon passing through a leading edge of said body.

28. The bicycle helmet of claim 27, wherein said spaced openings are spaced below a horizon passing through a lower front edge of said body.

29. The bicycle helmet of claim 27, wherein said reinforcement structure comprises a shell covering at least a portion of an outer surface of said base.

30. The bicycle helmet of claim 27, wherein said reinforcement structure comprises an internal reinforcement frame.

31. The bicycle helmet of claim 27, wherein no portion of said strap arrangement is secured to said retention mechanism.

32. The bicycle helmet of claim 27, additionally comprising one or more ventilation openings defined within a rearward portion of said body, wherein said spaced openings are disposed between a lower edge of said body and said ventilation openings.

33. The bicycle helmet of claim 32, wherein said ventilation openings have an area of at least about one-half square inch.

34. The bicycle helmet of claim 33, wherein said spaced openings each have an area of about one-sixteenth square inch.

35. The bicycle helmet of claim 27, wherein said retention mechanism is movable relative to said body.

* * * * *

UNITED STATES PATENT AND TRADEMARK OFFICE

CERTIFICATE OF CORRECTION

PATENT NO. : 7,376,980 B2
APPLICATION NO. : 11/407717
DATED : May 27, 2008
INVENTOR(S) : Christopher Bullock and Chris Pietrzak It is certified that error appears in the above-identified patent and that said Letters Patent is hereby corrected as shown below:

At column 4, line 37, please delete "35b," and insert -- 36b, --, therefor.

At column 10, line 19, in Claim 25, please delete "14" and insert -- 15 --, therefor.

Signed and Sealed this

Fourth Day of November, 2008

JON W. DUDAS
*Director of the United States Patent and Trademark Office*